United States Patent [19]

Monte et al.

[11] 4,328,868

[45] May 11, 1982

[54] FIRE SUPPRESSANT IMPACT DIFFUSER

[75] Inventors: Anthony J. Monte, Utica; Ernest C. Wahoski, Harper Woods, both of Mich.

[73] Assignee: The United States of America as represented by the Secretary of the Army, Washington, D.C.

[21] Appl. No.: 111,040

[22] Filed: Feb. 29, 1980

[51] Int. Cl.[3] ..... A62C 35/12

[52] U.S. Cl. ..... 169/62; 169/28; 169/74; 239/498; 239/502; 403/347

[58] Field of Search ..... 169/26, 28, 62, 71, 169/74, 77, 88, 89; 403/347; 239/498, 502, 518, 524, 552

[56] References Cited

U.S. PATENT DOCUMENTS

| | | | |
|---|---|---|---|
| 740,900 | 10/1903 | Oberwalder | 239/502 X |
| 2,562,930 | 8/1951 | Mapes | 169/74 |
| 2,778,685 | 1/1957 | Umbricht | 239/518 |
| 3,491,783 | 1/1970 | Linsalato | 169/28 X |
| 3,915,237 | 10/1975 | Rozniecki | 169/62 |
| 3,966,337 | 6/1976 | Crawford | 403/347 X |
| 4,020,904 | 5/1977 | DePalma | 169/74 |

*Primary Examiner*—Howard N. Goldberg
*Assistant Examiner*—Fred A. Silverberg
*Attorney, Agent, or Firm*—Peter A. Taucher; John E. McRae; Nathan Edelberg

[57] ABSTRACT

A bullet-shaped deflector located at the exit opening of a liquid nozzle mounted on a fire-suppressant storage bottle stationed within a military vehicle. The deflector acts as an obstruction to reduce liquid jet issuing from the nozzle. The system is designed for liquid pressure of 750 p.s.i. and nozzle openings of about $1\frac{1}{4}$ inch diameter. The bullet-shaped deflector may have a diameter of about 5/16 inch and an axial length of about 1 inch.

2 Claims, 6 Drawing Figures

FIRE SUPPRESSANT IMPACT DIFFUSER

The invention described herein may be manufactured, used and licensed by or for the Government for governmental purposes without payment to me of any royalty thereon.

BACKGROUND AND SUMMARY OF THE INVENTION

U.S. Pat. No. 3,915,237 issued to E. J. Roznieck on 28 October 1975 discloses a fire-suppressant system for a military vehicle that includes one or more thickwalled bottles containing fire-suppressant liquid, such as Halon 1301 (bromotrifluoromethane) pressurized to about 750 p.s.i. The system includes one or more optical fire detectors or sensors arranged within the vehicle to respond to emergent fireballs generated by passage of enemy projectiles through the vehicle fuel tank. The optical detector electrically triggers an explosive squib actuator for a fast-acting valve mounted on the fire-suppressant bottle.

One aim of the system disclosed in the patent is to suppress near-explosive fires within a very short period of time, e.g. one tenth of a second (100 milliseconds). To accomplish this aim it is necessary that the liquid fire-suppressant pressure be relatively high, on the order of 700–800 p.s.i. It is also necessary that the bottle discharge nozzle have a relatively large passage diameter, at least about 1¼ inch. With high liquid pressures and relatively large nozzle passage diameters it is possible to deliver relatively large quantities of fire-suppressant into the emergent fireball before the fireball propogates into unmanageable proportions.

The large mass flow rate of liquid fire-suppressant presents a problem in regard to personnel safety. Measurements taken with a load cell and impactor plate aligned on the nozzle axis show a liquid impact force of about 600 pounds at 1 inch from the nozzle exit opening. This force corresponds roughly to the force of a 16 pound bowling ball traveling at a speed of 40 miles per hour. Such a high impact force is sufficient to injure or knock down a soldier standing or crouching within the vehicle. The present invention seeks to minimize or reduce this impact force without seriously degrading the fire-suppression performance of the system.

THE DRAWINGS

FIG. 1 is taken generally along line 1—1 in FIG. 2.

Figure 1:
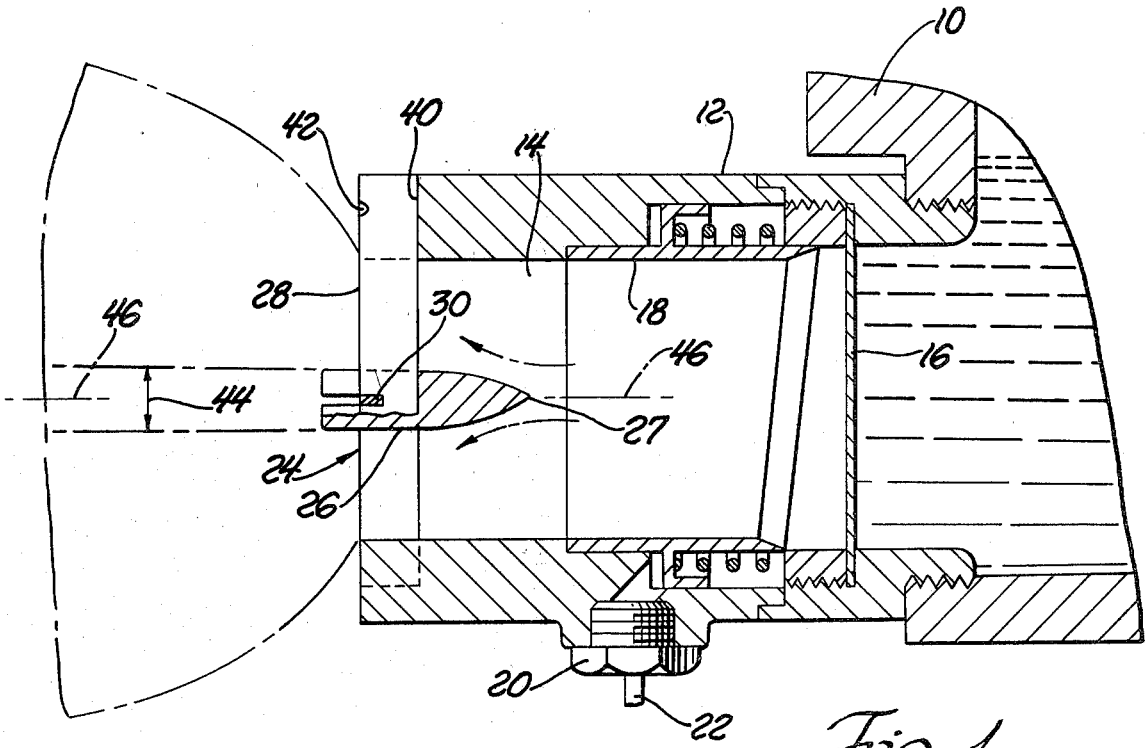
FIG. 1 is a fragmentary sectional view of a fire-suppressant bottle having a conventional control valve at its exit opening and a flow deflector element therein constructed according to the present invention.
Figure 2:
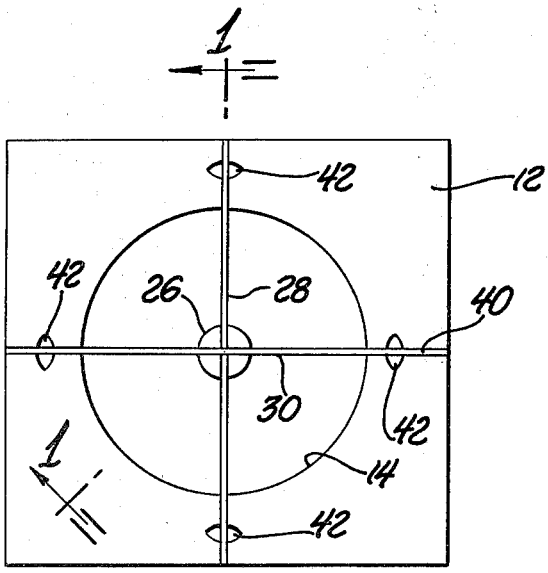
FIG. 2 is a left and elevational view of the FIG. 1 structure.
Figure 6:
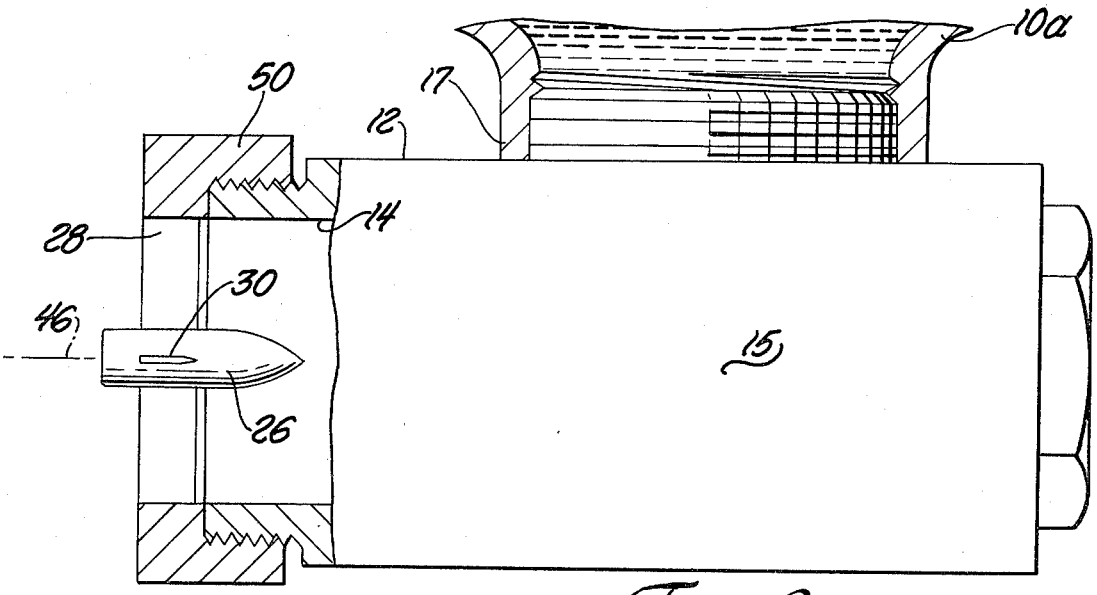
FIG. 6 illustrates a different bottle system equipped with a liquid deflector similar to that shown in FIG. 1.

Referring in greater detail to FIG. 1, there is shown a thick-walled bottle 10 that may be constructed similarly to the bottle shown in FIGS. 6 through 8 of U.S. Pat. No. 3,915,237, issued on Oct. 28, 1975 to E. J. Roznieck. The bottle is equipped with a liquid discharge fitting or nozzle 12 at or near its lower end, said fitting defining a generally horizontal cylindrical exit passage 14 for conveying pressurized liquid fire-suppressant (e.g. Halon 1301) in a right-to-left direction. During a standby period passage 14 is closed by a frangible metal diaphram or valve 16. The passage is opened in a conventional fashion by means of annular knife element 18 that is moved in a left-to-right direction by means of an explosive squib actuator 20 having electrical lead wire 22. The actuating system may be constructed as shown and described in U.S. Pat. No. 3,491,783 issued to O. L. Linsalato on Jan. 27, 1970.

Figure 3:
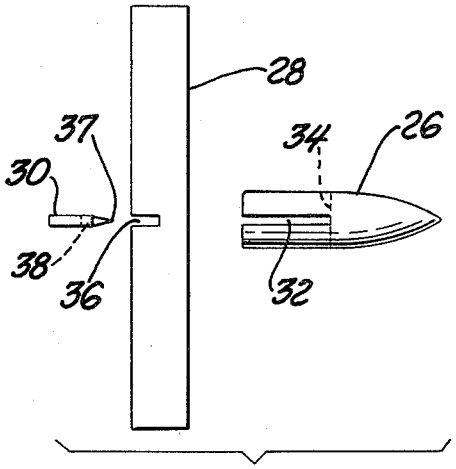
FIG. 3 is an exploded view showing components used in the FIG. 1 flow deflector.
Figure 5:
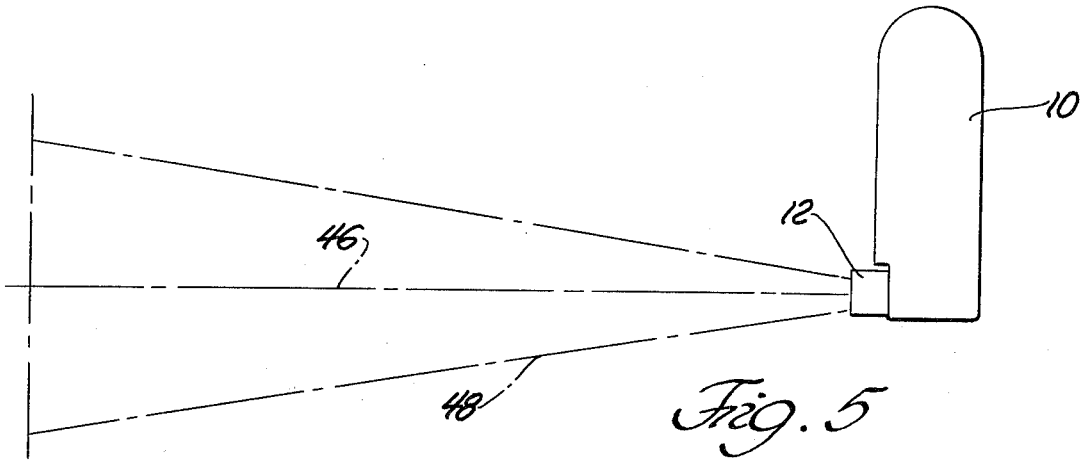
FIG. 5 represents the flow pattern produced by a bottle system not having the FIG. 1 liquid deflector mechanism.

The present invention is directed especially to a liquid deflector mechanism 24 that comprises a bullet-shaped deflector element 26 and two fin-like struts 28 and 30 arranged in a crossing or intersecting pattern at the downstream end of the nozzle passage 14. As shown in FIG. 3, deflector element 26 is provided with a slot 32 extending forwardly from its trailing end to approximately a mid-point on the element length. A second similar slot 34 is arranged in the deflector element at right angles to slot 32, for interfitting engagement with the crossed struts 28 and 30. Strut 28 is provided with a slot 36 extending forwardly from its trailing edge; strut 30 is provided with a similarly dimensioned slot 38 extending rearwardly from its leading edge, whereby the crossed fins 28 and 30 can interfit together as shown in FIG. 1. Slots 32 and 34 in deflector element 26 are as wide as the transverse thickness of struts 28 and 30 so that element 26 can be inserted onto the crossed fins as shown in FIG. 1. Deflector element 26 occupies a position on the flow axis of passage 14.

It is necessary that liquid deflector mechanism 24 be rigidly mounted and retained relative to fitting 12; otherwise the very high liquid pressures, on the order of 750 p.s.i., could explode element 26 to the left, thus endangering personnel located in line with the nozzle 12 axis. In the illustrated arrangement fins or struts 28 and 30 have their outer extremities located within radial slots 40 in fitting 12. The struts can be rigidly anchored to the wall of fitting 12 by staking or deforming each fin, as at 42. Additionally, the fin-wall joint can be welded to provide additional assurance against dislocation of the liquid deflector mechanism.

Figure 4:
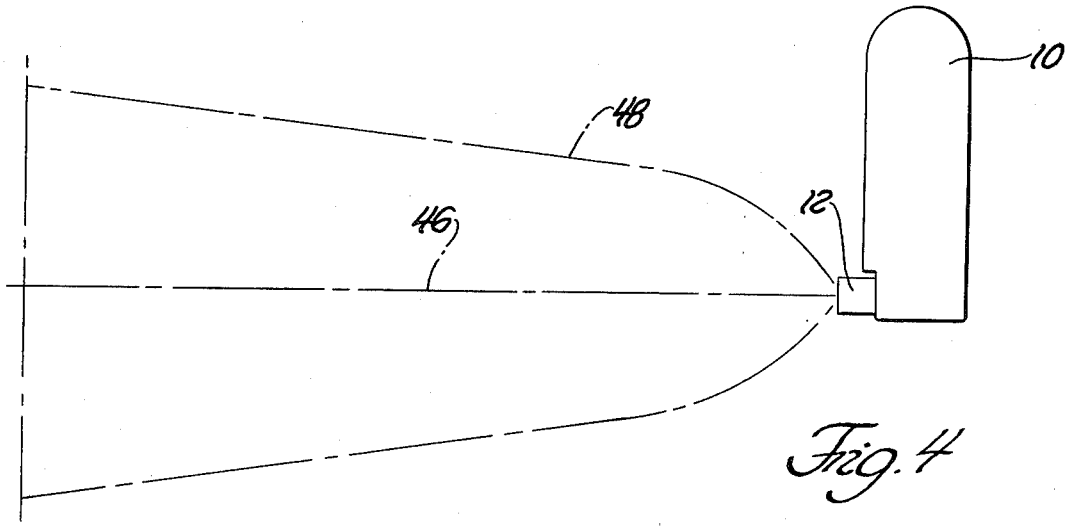
FIG. 4 is a schematic representation of the flow pattern issuing from the FIG. 1 fire-suppressant bottle system.

The fins 28 and 30 are intended to act solely as devices for mounting deflector element 26. The fins do not function as flow deflectors or controllers. Deflector element 26 is intended to reduce the flow velocity in the wake area 44 defined by the dashed lines in FIG. 1. In actuality liquid does begin to occupy the wake area at some point downstream from deflector element 26. However the velocity on axis 46 is less than it would otherwise be if element 26 were not used. The net effect of using deflector 26 is to reduce the liquid impact force along the line defined by axis 46. Deflector 26 also apparently has the advantageous action of somewhat increasing the diameter of the liquid jet issuing from the nozzle as defined by the jet profile line 48 in FIG. 4. Rough measurements taken with a system having an operating pressure of 750 p.s.i. and a nozzle passage 14 diameter of 1¼ inch, show a liquid jet diameter in excess of 2 feet at a point 6 feet from the nozzle. When the same nozzle was used without the deflector element the diameter of the liquid jet measured 6 feet from the nozzle was considerably less than 2 feet in diameter. A relatively large diameter liquid jet is advantageous in providing better or more extensive coverage of an emergent fireball in approximate alignment with the nozzle axis. The wider jet profile 48 is principally advantageous in reducing the high peak impact pressure that otherwise exists along the nozzle axis 46, thereby minimizing the danger to soldiers standing or kneeling in the vehicle in line with the nozzle. The relatively wide jet 48 has a diffused pattern that is relatively constant across the width of the jet from one edge to the other. The essentially constant pressure pattern presents less of a destructive threat to personnel while at the same time providing a relatively uniform coverage of the fireball within the flow pattern circumference, even at distances up to about 8 feet from the nozzle.

The size of deflector element 26 relative to passage 14 diameter may be varied, depending on such factors as the liquid suppressant pressure and the absolute passage 14 diameter. However one satisfactory arrangement included a deflector element 26 having a diameter of about 5/16 inch (0.07 square inch frontal area) and an axial length of about 1 inch. The passage 14 diameter in this arrangement was $1\frac{1}{4}$ inch. Struts 28 and 30 are preferably as thin as possible consistent with their element 26-support function. In one case each strut had a thickness of about 0.05 inch and axial width of about $\frac{1}{4}$ inch; the leading edge of the struts were sharpened or tapered as shown at 37 in FIG. 3 to reduce the liquid force that tends to blast the deflector mechanism 24 from nozzle 12. By sharpening the leading edges of these struts the impact force is redirected, thus effectively reducing its adverse action on the struts.

It will be noted that the fins or struts 28 and 30 join or interconnect with deflector element 26 at a point downstream from the convergent nose 27. The intent is to leave nose 27 symetrical or smooth around the entire nose, for a gradual redirection or deflection of the liquid with a minimum of destructive turbulence that would appreciably reduce the mass flow rate through the nozzle. In this connection, it should be remembered that a principal objective of the invention is to deliver fire-suppressant material to a designated fireball target zone in a minimum time period, e.g. 5 pounds of suppressant within 25 milliseconds. The location of fins 28 and 30 downstream from nose 27 of deflector 26 tends to reduce flow-impeding turbulence that might otherwise be generated.

The frontal area of deflector element 26 is preferably quite small in relation to the cross sectional area of passage 14. For example an element 26 diameter of 5/16 inch corresponds to a frontal area of about 0.07 square inch, and a passage 14 diameter of $1\frac{1}{4}$ inch corresponds to a cross sectional area of about 1.2 square inch; the deflector frontal area is only about 5% of the passage area. It is believed that deflector frontal areas of about 0.07 square inch can be used with passage 14 areas in the range from 0.8 square inch to 1.8 square inch, while obtaining desired flow diffusion and high flow rate objectives. Best operation is believed to result when the nose of element 26 has a gradual forward taper or convergence as shown in FIG. 1. Also, it is believed desirable to dispose deflector element 26 within the nozzle rather than downstream from the nozzle.

FIG. 1 shows the liquid flow deflector mechanism 24 incorporated directly in nozzle fitting 12. Fig. 6 shows the liquid flow deflector mechanism as a screw-on connection separately formed from fitting 12. In this case fitting 12 forms part of a solenoid valve designated by numeral 15. The valve is mounted on a vertical neck section 17 of a conventional upright bottle 10*a*. The operation of deflector mechanism 24 (FIG. 6) is similar to that of the previously described mechanism.

The illustrated mechanism functions in a somewhat similar fashion to the deflector mechanism shown in aforementioned U.S. Pat. No. 3,915,237, see reference numeral 56 therein. However, in the patented arrangement the deflector element takes the structural form of a rod 56 extending across the diameter of the nozzle exit opening. The rod has a uniform thickness along its length. Therefore if the rod is made with a cross-sectional diameter sufficient to achieve significant liquid deflection on the nozzle axis then the rod may produce undesired flow restriction in the areas near the side wall of the passage. Also, the patented rod 56 acts as a spreader device in only one plane, e.g. the horizontal plane, whereas liquid deflector 26 shown in the attached drawings diffuses or spreads the flow in a number of radial planes taken through nozzle axis 46. Deflector 26 is located within flow passage 14, whereas the rod 56 shown in the patent is located downstream from the flow passage. Deflector 26 separates the flow into an annular cross-sectioned stream having radially outwardly-directed flow components as it exits from the passage; this is believed to contribute toward a satisfactory diffuser action with a minimum of destructive turbulence.

The present deflector is believed to have advantages over the patented deflector in such respects as minimal obstruction to high mass flow rate, protection to personnel located in line with the nozzle axis, uniformity of target coverage, and a satisfactorily large pattern of coverage. The liquid pattern produced by deflector 26 is generally circular (measured in planes transverse to axis 46) and of uniform density.

I wish it to be understood that I do not desire to be limited to the exact details of construction shown and described for obvious modification will occur to a person skilled in the art.

I claim:

1. In a fire suppressant system for the interior space within a military vehicle, comprising an upright pressure-resistant bottle containing pressurized fire suppressant liquid at a pressure on the order of 750 p.s.i.; a discharge fitting connected to a lower section of the bottle and defining a horizontal cylindrical exit passage having an exit opening for the pressurized liquid; and openable valve means in the discharge fitting normally preventing liquid discharge from the bottle through the exit passage: the improvement comprising an axially elongated bullet-shaped liquid deflector element secured to the exit opening and located within the passage on the passage axis at the downstream end of the fitting, and at least two radial fins rigidly positioning the deflector element in its designated position; the deflector element having a cylindrical section connected to the radial fins, and a convergent leading nose section located upstream from the fins; the surface of the convergent nose section making a smooth gradual transition to the surface of the cylindrical section; the frontal area of the deflector element being approximately 0.07 square inches, and the passage area being in the range of 0.8 square inches to 1.8 square inches; the deflector element being disposed so that its convergent nose section is located upstream from the plane of the exit opening defined by the discharge fitting; the plane of the exit opening passing through the cylindrical section of the deflector element upstream from the element trailing end, whereby the deflector element produces radially outwardly directed flow components in the liquid as it exits from the discharge fitting.

2. The improvement of claim 1 wherein the passage area is approximately 1.2 square inch, and the liquid deflector element has an axial length of about one inch.

* * * * *